US006347638B1

(12) United States Patent
Scott et al.

(10) Patent No.: US 6,347,638 B1
(45) Date of Patent: Feb. 19, 2002

(54) ARTICLE OF MANUFACTURE FOR A PORTABLE SHELTER SUSPENDED ABOVE THE GROUND

(76) Inventors: James I. Scott, 903 WH Long Rd, Centralia, WA (US) 98531; George D. Scott, 550 NE Adams, Chehalis, WA (US) 98532

( * ) Notice: Subject to any disclaimer, the term of this patent is extended or adjusted under 35 U.S.C. 154(b) by 0 days.

(21) Appl. No.: 09/343,422

(22) Filed: Jun. 30, 1999

(51) Int. Cl.[7] ..... E04H 15/30

(52) U.S. Cl. ..... 135/95; 135/90; 135/96; 135/115; 135/121

(58) Field of Search ..... 135/90, 115, 95, 135/96; 5/121, 127–130, 95, 96

(56) References Cited

U.S. PATENT DOCUMENTS 979,037 A * 12/1910 Searle ..... 135/96
1,621,464 A * 3/1927 Fortin ..... 135/96
3,619,827 A * 11/1971 Mackenzie ..... 135/96
4,071,917 A * 2/1978 Mojica ..... 5/121
4,308,883 A * 1/1982 Malone ..... 135/96
4,320,542 A * 3/1982 Cohen ..... 5/121
4,686,720 A * 8/1987 Newell ..... 5/121
5,042,517 A * 8/1991 Stewart ..... 135/90
5,072,465 A * 12/1991 Lyons ..... 135/90
5,715,552 A * 2/1998 DeAth ..... 135/96
5,913,772 A * 6/1999 Clark ..... 5/121
6,085,767 A * 7/2000 Maslow ..... 135/95

* cited by examiner

*Primary Examiner*—Beth A. Stephan

(57) ABSTRACT

An article of manufacture for a portable shelter suspended above the ground having a flexible floor supported by a plurality of straps, a flexible framework attached to the floor, a canopy suspended over the framework for enclosing a space; and support means attached to the framework for attaching the shelter to a plurality of load bearing members. The floor may be further supported by rigid support poles made of PVC placed within a fold sewn along the shorter length of both ends of the floor. The floor may be further supported by diagonally crossing support straps under the floor. In another preferred embodiment, the floor may be rigid.

19 Claims, 5 Drawing Sheets

ARTICLE OF MANUFACTURE FOR A PORTABLE SHELTER SUSPENDED ABOVE THE GROUND

BACKGROUND OF THE INVENTION

This invention relates generally to the field of portable shelters, and more particularly to a portable shelter suspended above the ground.

Tents have throughout history been an integral part of camping and hiking. Several problems are inherent to laying on thin fabric placed directly on the ground, including contact with and accessibility to animals of all kinds, the gathering of water at the lower seams, uncomfortable lumps and uneven terrain, and much more—inspiring the development of a new type of portable shelter: shelters elevated above such a problematic surface. Some of the first elevated shelters consisted of a hammock attached to a sleeping bag, while others consisted of a hammock crudely attached to a cover, and many versions of both forms used the end for entry (a difficult method due to limited space and the interference of suspension lines) rather than the side of the shelter for entry. Later forms of elevated shelters attempted to improve upon earlier forms; however, prior elevated shelters in all cases have problems in many areas, detracting from their overall usefulness and comfort. The following is a list of problems, combinations of which plague all prior portable elevated shelters:

1) There is an excess of longitudinal sag, causing undue strain on the lower back and elevating the feet far above the rest of one's body, causing hyper-extensive pressure on the knees. 2) There is an excess of latitudinal sag, causing a sandwiching effect which restricts the user's movement, makes leaving the shelter a difficult task, and also hangers the ability to create a suitable surface for more than one occupant. 3) Because of the design, the floor tips from side to side when an occupant repositions him/herself, and makes it a near impossibility to sleep anywhere but along the longitudinal centerline. 4) The shelter requires attachment means to the ground or to object(s) to the side(s) of the shelter for stabilization of the structure and/or to straighten the floor. 5) There are many sewn areas in the canopy for connecting poles, fasteners and the like, which reduce the rain resistance of the shelter. 6) There is little or nothing designed to prevent or aid spreader bars against direct pressure upon the center of the bars and/or spreader bars are irremovably internalized or have lines threaded through them to connect them to the hammock body, making the use of lightweight disconnectable spreader bars impossible and thus increasing minimum weight and not allowing a decrease in the width of the shelter when the shelter is put away. 7) The shelter is bulky and cumbersome when put away because of its need for many poles, particularly those poles which are curved (typically used for elevating the canopy) and those which are of great length (usually used as longitudinal reinforcing bars). 8) The ropes which attach to load bearing members may not be pulled taut because such pulling would cause undue strain on the materials throughout the shelter; the looser the pull the more the lines and floor sag longitudially, necessitating that points of attachment to load bearing members be ever higher, particularly when such load bearing members are considerably distant. 9) The lines used to suspend the shelter and maintain its shape easily become entangled. 10) The canopy gathers rain and snow, or to avoid such a gathering the structure requires rigid objects to convexly shape the canopy. 11) The manufacturing process is complex, resulting in increased time-consumption and increased possibility for errors in the manufacture of the shelter. 12) The shelter is difficult to set up and take down. 13) The shelter has an unsightly amount of sag, appears as if it were a cocoon, and/or for other reason(s) is aesthetically displeasing.

SUMMARY OF THE INVENTION

The primary object of the invention is to provide a more comfortable portable shelter that is elevated above the ground. Another object of the invention is to provide an elevated portable shelter with a minimum of two horizontal spreader bars which maintains a relatively level floor from side to side and from end to end. Another object of the invention is to provide a surface suitable for occupant(s) to lay in comfort, varying widths allowing for single or multiple occupancy versions using the same design specifications and providing that the floor is of suitable width. A further object of the invention is to provide an elevated portable shelter which maintains a stable form that does not tip to either side or to either end, regardless of whether or not load(s) are placed upon the floor of said shelter, and also regardless of the location of said load(s) upon said floor. Still yet another object of the invention is to provide an elevated portable shelter which achieves all functions described without necessitating that any part of the shelter touch the ground or object(s) to the side(s) of said shelter for means of stabilization. Another object of the invention is to provide an elevated portable shelter which achieves all functions described with a minimal amount of necessary sewn locations in the canopy of said shelter. Another object of the invention is to provide support for the spreader bars and to provide a reliable method of inserting and removing spreader bars. Another object of the invention is to provide an elevated portable shelter which achieves all functions described with a minimal number of poles. Still yet another object of the invention is to provide an elevated portable shelter which may be pulled taut without causing undue strain on any of the shelter's materials, helping to level the floor, add stability, and avoid necessitating that points of attachment to load bearing members be considerably higher than said shelter. A further object of the invention is to minimize entanglements. A further object of the invention is to provide a convex canopy without requiring additional rigid material(s). Another object of the invention is to provide an elevated portable shelter which is designed so that the majority of lines of attachment are straight; and so that the process of manufacture is relatively simple and straightforward. Another object of the invention is to provide an elevated portable shelter which is quick and easy to set up and to take down Yet another object of the invention is to provide an elevated portable shelter which is aesthetically pleasing, even when under load.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an article of manufacture for a portable shelter above the ground having a flexible floor supported by a plurality of straps, a flexible framework attached to the floor; a canopy suspended over the framework for enclosing a space, and support means attached to the framework for attaching the shelter to a plurality of load bearing members. The floor can be further supported by straps criss-crossing the bottom of the floor and two rigid support poles affixed within the floor running transverse to the length of the floor and encased within a sewn cylindrical pouch created within the floor structure.

In accordance with another preferred embodiment, there is disclosed an article of manufacture for a portable shelter suspended above the ground having a rigid floor, a flexible framework attached to the floor, a canopy suspended over the framework for enclosing a space, and support means attached to the framework for attaching the shelter to a plurality of load bearing members.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
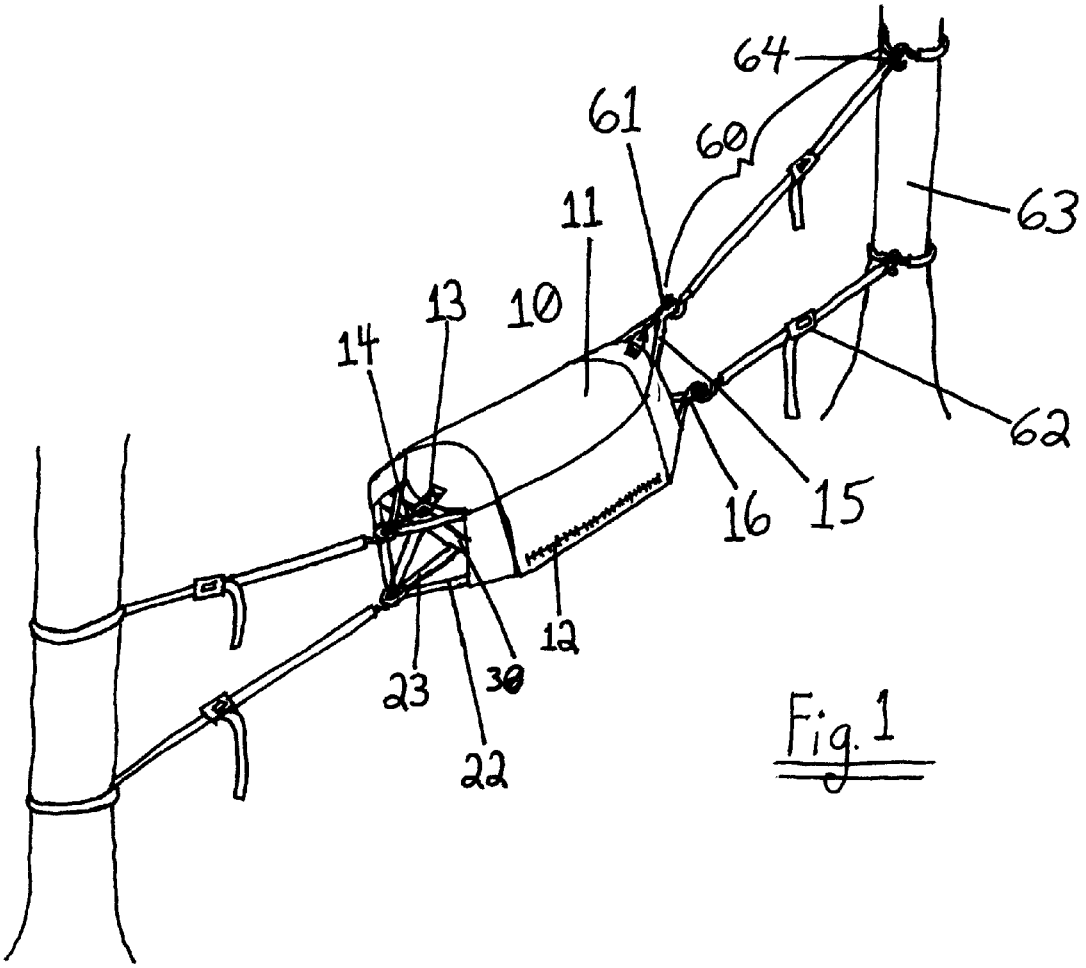
FIG. 1 is a perspective view of the preferred embodiment of the invention in use, with canopy and end covers.

Turning now to the Figures, it is evident that the shelter 10 comprises most generally a plurality of lines, a canopy 11 and a rectangular floor 20. FIG. 1 best illustrates the canopy 11 and means for suspending said shelter 10 above the ground. In the preferred embodiments, all lines with the exception of cover-pul lines 14, consist of nylon straps. Said lines consisting of nylon strap may, however, consist of any type of lines suitable for the tasks set forth for said lines herein. Herein throughout the rest of detailed description all lines with the exception of said two lines 14 shall be referred to simply as straps. In the preferred embodiment of said shelter 10, said material comprising said canopy 11 is suspended upward and outward from the center longitudinal axis line of said floor 20 (seen best in FIG. 3) by hanging over a pair of upper load straps 15 and attaching to said floor 20 and/or lower load straps 22 along the length thereof In the preferred embodiment, said attachments extend along said lower load straps 22 beyond the shortest edges of said floor 20, thus extending said canopy 11 above an empty trapezoidal space at either end of said floor 20; reason for such extension is explained later. In the preferred embodiment, said attachment means consist of sewn lines. Means of attachment, however, may consist of buttons along same said length of attachment or any portion thereof, allowing for optional removal of said canopy 11; means of attachment may alternately consist of zippers in close proximity to and parallel to said lines of attachment; means of attachment may alternately consist of any suitable method of attachment. Said canopy 11 most preferably consists of a lightweight, weather resistant fabric such as 70 denier nylon rip-stop, and is also most preferably coated with a water-repellency treatment.

As exemplified by FIG. 1, a means for entry through said canopy 11 consists, in the preferred embodiment, of a straight length of zipper 12 parallel to and in close proximity to one said lower load strap 22 and not extending beyond vertical straps 41 (said vertical straps 41 illustrated in FIG. 2); convenient entry through such zipper entry is allowed for by the elevation of said shelter 10 above the ground. The shape of said zipper entry 12 may differ from its form illustrated in FIG. 1, such as consisting of a U shape, instead consisting of a right angled zipper entry, or instead comprised of any other suitable zipper means of passage into the area covered by said canopy 11. Means of entry may also consist of said removable canopy method through implementation of said buttons or said zipper connecting said canopy 11 to said floor 20 along lines of attachment, or may comprise a combination of said removable canopy method and any appropriate form of zipper entry.

As seen in FIG. 1, the preferred embodiment of said canopy 11 includes a convexly rounded upper portion; means for pulling said upper portion into said shape as in FIG. 1 is provided for by the attachment of two small pieces of material 13 with apertures to the upper portion of said canopy 11 at either end and also removably attached to a pair of lines 14. Said lines 14 most preferably consist of thin semi-elastic rope; each of said lines 14 may instead consist of nylon straps, braided rope, or any other fine of suitable strength for puffing said upper portion of said cover 11 into a convexly rounded shape. Said ropes 14 are attached at one end to said materials 13 and at the other end to higher points than that of said materials 13; higher points are exemplified as being loops 16 at either end of said upper load straps 15, best seen in FIG. 5, although any points of same or greater elevation to which ropes 14 my be attached give same or better results. When pulled in such a way, upper portion of said canopy 11 becomes convexly rounded, particularly so when said shelter 10 is under load. Other means of shaping said upper portion of said cover 11 convexly may comprise a singe line extending throughout the underside of said upper portion with attachment points to two spaced points of higher elevation, or any similar means.

Figure 5:
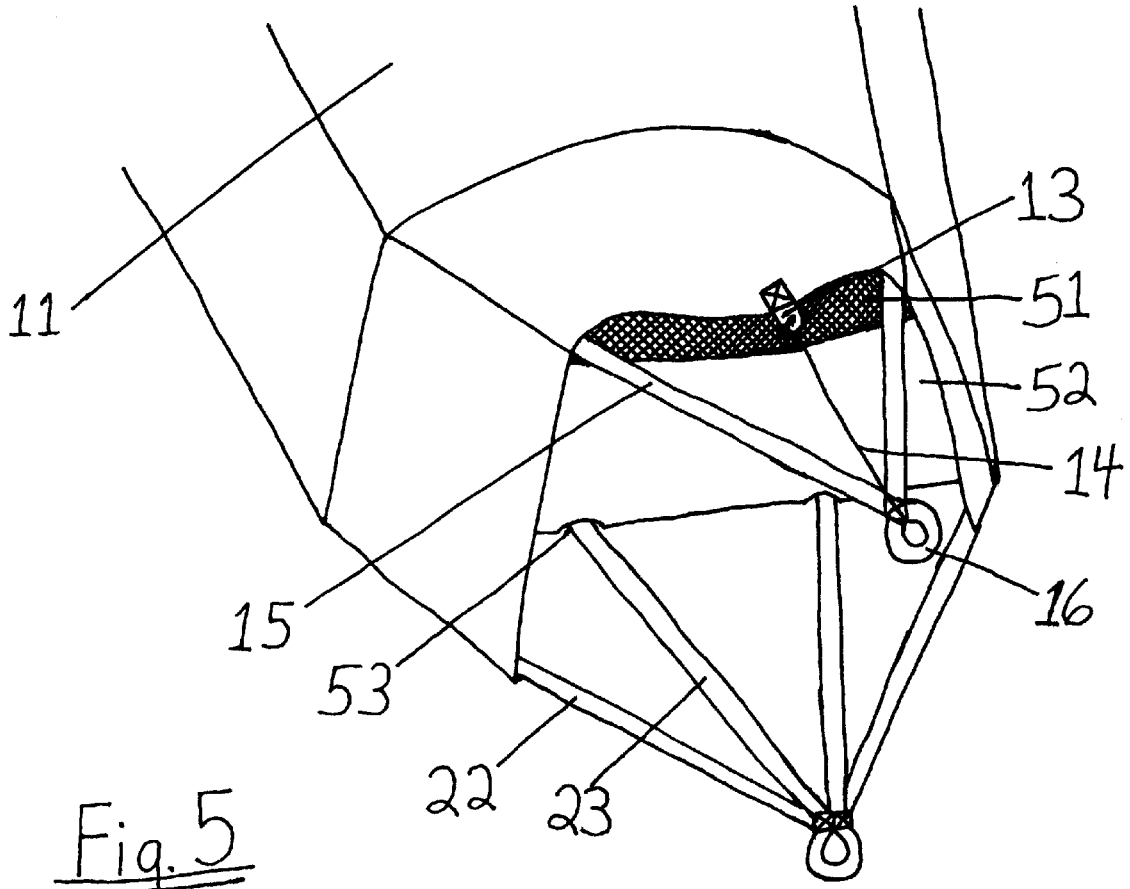
FIG. 5 is a perspective view of an end of the preferred embodiment of the shelter in use, with canopy and end covers.

Referencing FIG. 5, an illustration of an end cover 50 is given. Two of said end covers 50 are provided in the preferred embodiment-each wrapped around one of the shortest edges of said floor 20 via slits 53 along the bottom edges thereof for passage of material around said lower load straps 22 and said inner load straps 23; said end covers 50 are also attached to said canopy 11. Said end covers 50 are attached to each shortest edge of said floor 20 along the underside of said floor 20 or said cylinders 30 and attached along the underside of said canopy 11 transversely and nearly directly above and parallel to line of attachment to said floor 20; in the preferred embodiment, attachment means consist of sewn lies; buttons or zippers in close proximity to and parallel to same said fines of attachment may be substituted. In the preferred embodiment, the upper portion of said end covers 50 consist of a mesh screen 51 for allowing ventilation throughout the interior of said shelter 10 while also preventing the passage of insects into the same area. In the preferred embodiment, the lower portion 52 of said end covers 50 consist of the same type of material as of that comprising said canopy 11. Said end covers 50 cover the entire space between said canopy 11 and said floor 20. Said floor 20, said canopy 11, and said end covers 50 define an enclosure. In keeping with the preferred embodiment of said shelter 10, said canopy 11 extends over and beyond said end covers 50, creating an alcove in which said end covers 50 are removed from direct contact with falling precipitation, even in heavy winds; and also wherein amount of ventilation depends upon distance of extension of said end covers beyond said shortest edges of said floor 20. Said covered alcove allows implementation of said mesh screen 51 instead of necessitating that the entirety of said end covers 50 consist of a rain resistant material to protect the enclosed area of said shelter 10 from rain. Said end covers 50 may consist entirely of mesh, or may consist of any suitable materials).

Figure 2:
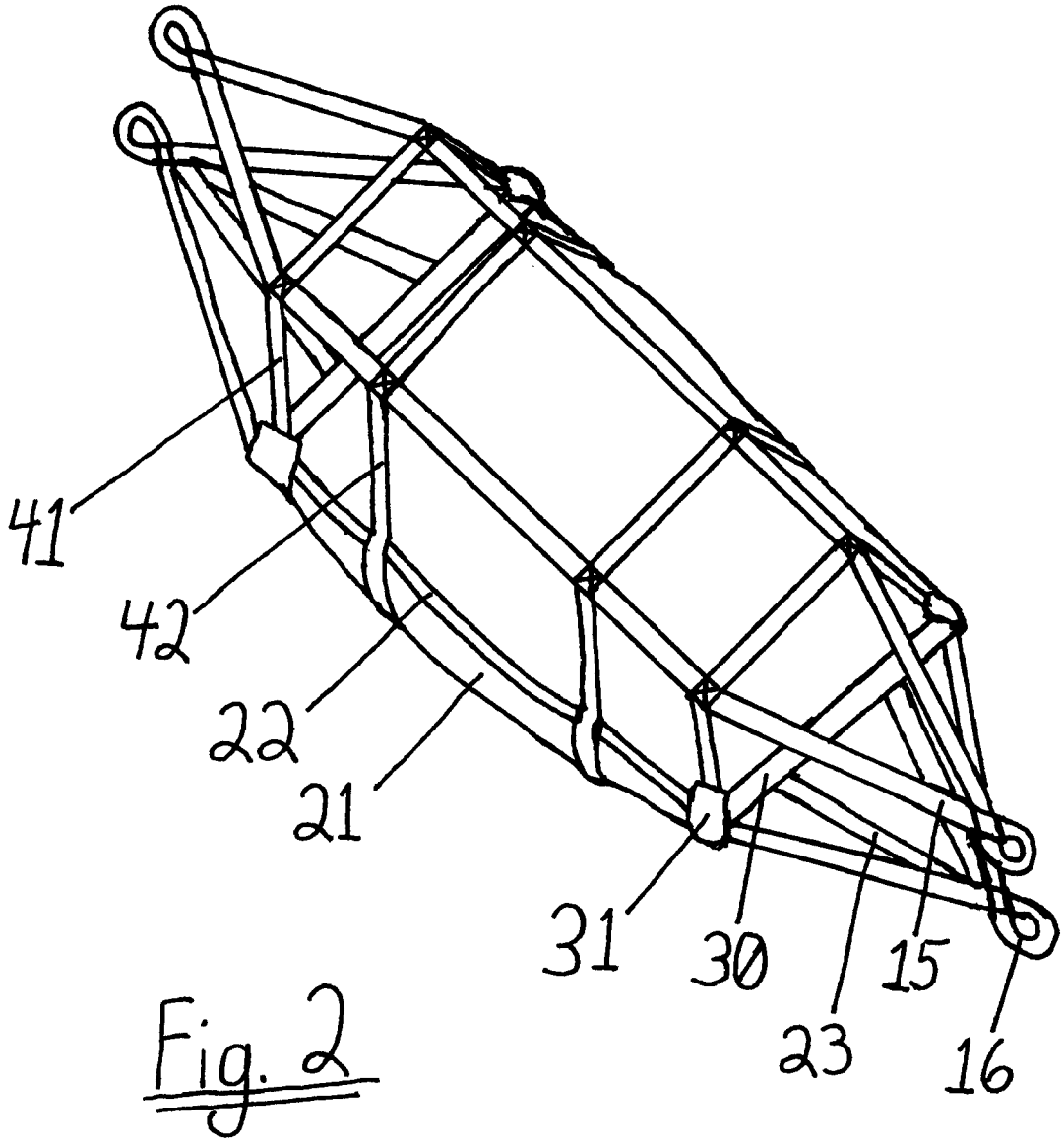
FIG. 2 is a perspective view of the invention in use without a canopy and without end covers.

FIG. 2 best illustrates the system of straps comprising the famework of the shelter. Said lower load straps 22 discontinue parallelism at said shortest edges of said floor 20 and each attaches to another set of inner load straps 23 and to each other at a point beyond shortest edges of said floor 20; said inner load straps 23 run between, nearly parallel to and equidistant to said lower load straps 22, and are preferably two in number, as illustrated. Said upper load straps 15 run parallel to the length of said floor 20 until reaching close proximity to shortest edges of said floor 20, whereupon said upper load straps 15 discontinue parallelism and attach to each other at a point beyond said floor 20. Furthermore, in the preferred embodiment, said upper load straps 15 and/or said lower load straps 22 form loops 16 at their points of attachment to their respective partners; said points of attachment may instead continue directly into lengths of lines or directly into j-hooks, said lines or said j-hooks providing means for connection to spaced load bearing members (load bearing members are represented as a pair of trees 63 in the illustration).

FIG. 1 illustrates the preferred means for attaching said shelter 10 to spaced load bearing members 63. As in FIG. 1, the means for suspending said shelter 10 in the preferred embodiment comprises four straps 60, each equipped with j-hooks 61,64 at either end. The preferred embodiment additionally provides that each of said straps 60 are also equipped with cam buckles 62 for tightening said straps 60 and all portions of said shelter 10 effected by such tightening, resulting in a more level floor 20 and a more stabilized and aesthetically improved shelter 10. Said j-hooks 61 attach to said loops 16 in the preferred embodiment; said straps 60, at the ends most distant from said loops 16, are looped around load bearing members 63 and hooked to themselves by way of said j-hooks 64. In the case that load bearing members comprise objects to which said j-hooks 64 may attach directly, direct attachment of said j-hooks 64 to said objects is most preferable. Any or all of said straps 60 may be void of any or all said j-hooks 61,64 and said cam buckles 62, and/or clasps in lieu of any or all said j-hooks 61,64 and/or winches in lieu of any or all said cam buckles 62 may be substituted; any conventional means for attaching straps to load bearing members and any conventional means for tightening straps may alternately be used in lieu of any or all said j-hooks 61,64 and cam buckles 62.

Figure 4:
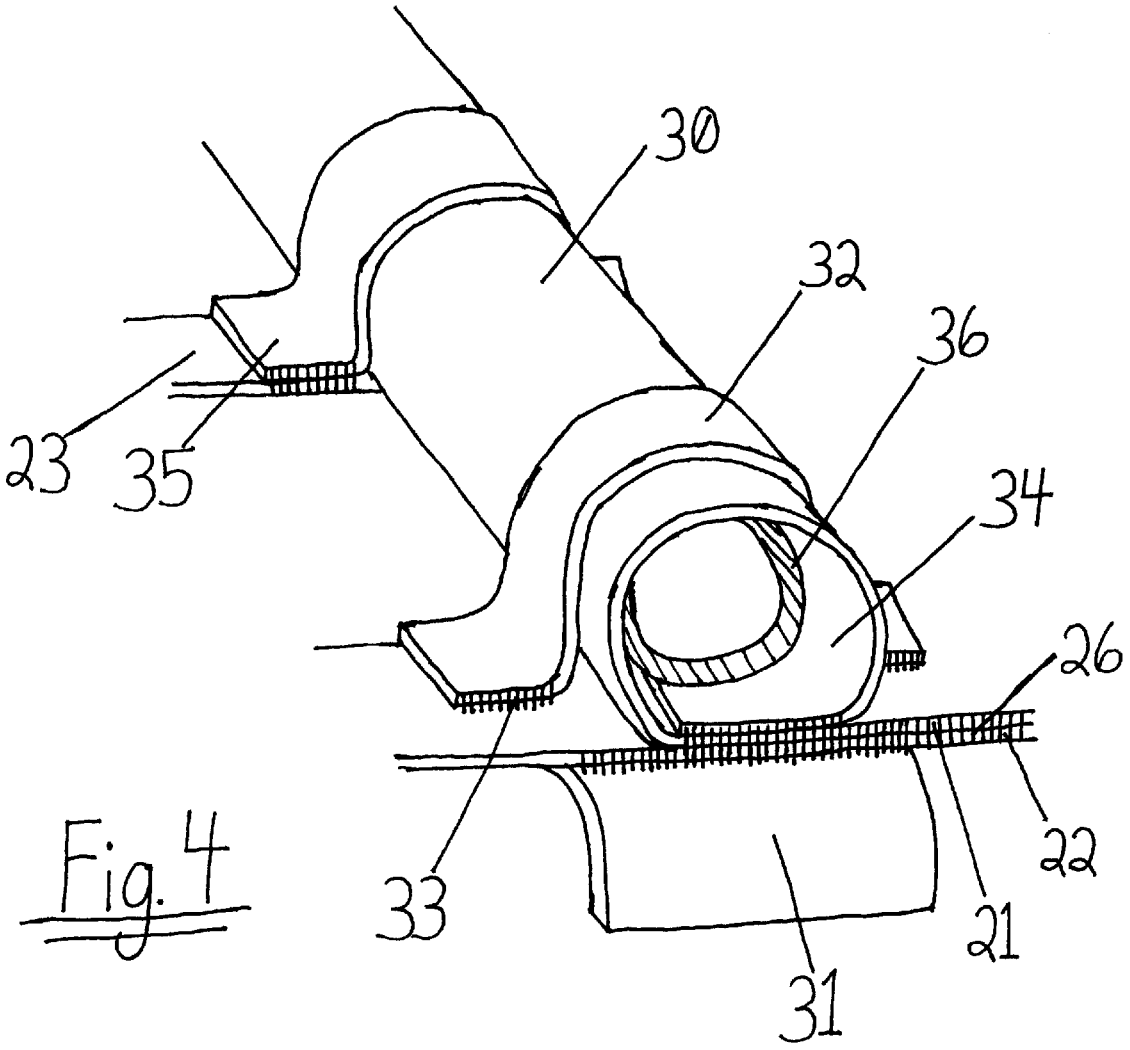
FIG. 4 is an exploded view of the end of a cylinder.

FIG. 4 illustrates the end portion of one of the two cylindrical pouches 30 of said floor 20. Means for creating said cylinders 30 comprises a folding of shortest edges of said floor 20 back onto said floor 20 and sewing along the line of contact. Said spreader bars 35 are additionally supported by said lower load straps 22 and said inner load straps 23: short lengths of strap 33 are looped half-way around said cylinders 30 and sewn to portions of each said lower load strap 22 and short lengths of strap 32 are similarly attached to each said inner load strap 23 and in close proximity to said cylinders 30; this design, in addition to reinforcing said spreader bars 35, also prevents undue stretch of said floor material 21 from the pulling of said lower load straps 22 and said inner load straps 23. The added support to said spreader bars 35 allows the implementation of light and inexpensive spreader bars 35 and also allows the implementation of mating or otherwise removably connected spreader bars 35 for means of decreasing spreader bar 35 length when the use of said shelter 10 is not desired. Said spreader bars 35 preferably consist of mating polyvinyl chloride (PVC) tubes. Short pieces of heavy-duty material 31 —preferably 2" to 3"—wide nylon straps—are attached to said lower load straps 22 adjacent or in proximity to the open ends 34 of said cylinders 30; apertures 34 allow the insertion and removal of said spreader bars 35 when said shelter 10 is not tightened or under load; when said shelter 10 is tightened or under load, said pieces of heavy-duty material 31 and said lower load straps 22 pull up and over said apertures 34, preventing the escape of said spreader bars 35. Said spreader bars 35 laterally level said floor 20 and also spread the weight of load(s) laterally across said floor 20.

Figure 3:
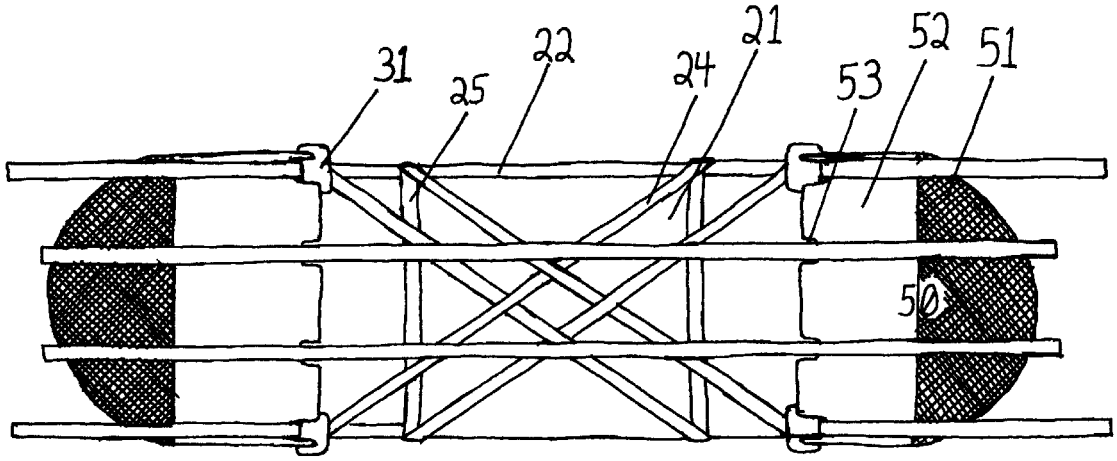
FIG. 3 is a plan view of the underside of the preferred embodiment of the floor with lower load lines attached to the floor but not yet to one another; also with attached end covers as they are before attachment to canopy.

As illustrated in FIG. 3, the underside of said floor 20 is reinforced by a system of straps 22,23,24,25. Straps 24,25 are attached to said lower load straps 22 and transverse said inner load straps 23. Said system of straps 22,23,24,25 is preferably sewn to floor material 21 along the entire length of each strap; said straps 22,23,24,25, however, are not required to be sewn along their entire length, neither are they required to be attached to any portion other than at two points generally distant from one another. Said transversing straps 24 are attached at points along said lower load straps 22 in close proximity to said cylinders 30 at one end or more preferably directly attached to said vertical straps 41, and at the other end are attached in close proximity to vertical straps 42 (illustrated in FIG. 2) at the attachment point of said vertical straps 42 to the other of said lower load straps 22, thusly importantly connecting five said sets of straps 22,24,25,41,42 at four points. Said system of straps 22,23, 24,25 provide reinforcement throughout said floor material 21 by means of distributing the strength of spreader bars 35 and strength of said upper load straps 15 throughout said floor 20. Transversing straps 24 may alternatively be of less length and be attached to said straps 22,25,42 in such a way as to use only two straps in the form of an X across said floor 20 and not attaching to points of close proximity to said cylinders 30; said alternate design is less preferable than previously stated design for transversing straps 24. The purpose of said transversing straps 25 is to reinforce said floor material 21; said transversing straps 25 may, therefore, be excluded from design altogether, particularly when said floor material 21 is of sufficient strength.

It may be preferable that said straps 22,23,24,25, said lengths of materials 31, and said floor material 21 be protected from the elements (particularly rain). Protection of such materials may be provided for by attaching the upper portion of a length of water-proof material to said floor 20 along the edges thereof or along said lower load straps 22, as a drip-edge; or by using canopy material of greater width than that specified hereto and sewing wider canopy material along in a fine parallel to yet above the edges of the wider canopy material along the lengths of said lower load straps 22. Alternately or in combination with first said methods is a method of protection comprised of the attachment of material with width and length approximately equivalent to said floor material 21 (after folding to create said cylinders 30), attached along lines parallel to and in close proximity to the edges of said floor 20 and/or along said lower load straps 22, or along edges of said canopy 11 or in close proximity thereto.

As seen in FIG. 2, the set of said inner vertical straps 42 are attached to said lower load straps 22 and said upper load straps 15 generally perpendicular to both said straps 15,22; said attachments interconnect said transversing straps 24,25, said inner load straps 23, said lower load straps 22, and said upper load straps 15. In the preferred embodiment, said vertical straps 41 are attached to said lower load straps 22 adjacent to said apertures 34, and also to said upper load straps 15, further connecting both sets of said load straps 15,22; and are also most preferably attached to said heavy-duty materials 31. Said vertical straps 41,42 transverse between said upper load straps 15 for means of reliably maintaining an inward slant of the generally vertical portions of said straps 41,42 and thus also helping to inwardly slant said canopy 11. Said system of straps 15,22,23,24,25, 41,42 in this way provide reinforcement to said floor 20, and more importantly, effectively distribute the weight placed upon said floor 20 between said floor 20 and all straps in said shelter 10; in so doing, said upper load straps 15 absorb much of the curvature which would otherwise be forced directly upon said floor 20: by said absorption, longitudinal sag of said floor 20 is decreased; also, by connecting said upper load straps 15 to said lower load straps 22 as herein detailed, said upper load straps 15 lower in elevation roughly equivalent to the distance which said lower load straps 22 lower when said shelter 10 is under load, preventing undue strain and stretch of material comprising said canopy 11. Furthermore, all straps in said shelter 10 effectively stabilize said floor 20, preventing excessive swaying and tipping thereof regardless of the area of said floor 20 upon which a load is placed. The functions of all straps used in said shelter 10, along with said spreader bars 35, allow for the comfortable use of said shelter 10 by multiple occupants provided width of said floor 20 is sufficient. The reinforcement provided for said floor 20 by said system of straps 22,23, 24,25 allows said floor material 21 to consist of thin fabric such as that used for said canopy 11 (such as 70 denier nylon rip-stop) and provide that said floor 20 still maintains great strength.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An article of manufacture for a portable shelter suspended above the ground comprising a flexible floor supported by a plurality of load lines, adding strength to the floor and also providing attachment means for attaching the lower portion of said shelter to two load bearing members separate from one another by at least the distance of said shelter; a flexible framework including load lines running above, parallel and slightly inward of the longest edges of said floor, providing attachment means for attaching the upper portion of said shelter to an upper portion of said load bearing members or other appropriate members of equal or higher elevation than upper load lines; having vertical load lines interconnecting said upper load lines with said floor and support lines thereof; with spreader bars provided at each of shortest edges of said floor for laterally stressing said floor when said shelter is suspended; with a canopy suspended over said floor for enclosing a space, including means for passage through said canopy, the canopy itself suspended upward at least in part by means of said upper load lines; all of said load lines as a whole comprising said flexible framework, said framework together with said spreader bars providing a structure which distributes the weight of a load evenly or near-evenly among the upper load lines and lower load lines and eventually the attachment means to said load bearing members and to the members themselves, also maintaining itself in an upright position regardless of where a load may be placed on said floor and also regardless of moderate to heavy winds, also providing a relatively level lateral spread and resisting longitudinal sag brought on by loads, all without necessitating the use of more than two rigid members each only as long as the structure is wide, and also without requiring that the shelter by any means attach to the ground for any reason.

2. An article of manufacture for a portable shelter suspended above the ground as claimed in claim 1 wherein means for inserting said spreader bars comprises a sewn fold of the shortest edge of said floor, forming a cylindrical shape.

3. An article of manufacture for a portable shelter suspended above the ground as claimed in claim 1 wherein said support means for suspending said shelter from load bearing members comprises two lines for removable attachment to each of said load bearing members.

4. An article of manufacture for a portable shelter suspended above the ground as claimed in claim 3 further comprising means for removably attaching said lines to said framework.

5. An article of manufacture for a portable shelter suspended above the ground as claimed in claim 1 further comprising material(s) attached to both shortest edges of said floor and to said canopy, thus covering space between said canopy and said floor at either end of said floor; said floor, said canopy, and said end covers define an enclosed shelter.

6. An article of manufacture for a portable shelter suspended above the ground as claimed in claim 1 further comprising a means for forming an inverted U- or V-shaped upper portion of said canopy along the length thereof.

7. An article of manufacture for a portable shelter suspended above the ground as claimed in claim 6 wherein said means for forming an inverted U- or V-shaped upper portion comprises the attachment of two lines, each attached at one end to an end of said canopy and other end of said lines attached to a point of higher elevation than said upper load lines.

8. An article of manufacture for a portable shelter suspended above the ground as claimed in claim 1 further comprising a length of material attached along edges of said floor and hanging therefrom as means for preventing the contact of rain water to straps reinforcing said floor.

9. An article of manufacture for a portable shelter suspended above the ground as claimed in claim 1 further comprising a length of material, approximately equivalent to the length and width of said floor material, attached along lines parallel to and in close proximity to said floor and/or along said lower load lines and completely covering the underside of said floor, preventing contact to underside of said floor and all lines along underside of said floor to the elements.

10. An article of manufacture for a portable structure suspended above the ground comprising a flexible floor supported by a plurality of load lines, adding strength to the floor and also providing attachment means for attaching the lower portion of said shelter to two load bearing members separate from one another by at least the distance of said structure; a flexible framework including load lines running above, parallel and slightly inward of the longest edges of said floor, providing attachment means for attaching the upper portion of said shelter to an upper portion of said load bearing members or other appropriate members of equal or higher elevation than upper load lines; having vertical load lines interconnecting said upper load lines with said floor and support lines thereof; with spreader bars provided at each of shortest edges of said floor for laterally stressing said floor when said structure is suspended; all of said load lines as a whole comprising said flexible framework, said framework together with said spreader bars providing a structure which distributes the weight of a load evenly or near-evenly among the upper load lines and lower load lines and eventually the attachment means to said load bearing members and to the members themselves, also maintaining itself in an upright position regardless of where a load may be placed on said floor and also regardless of moderate to heavy winds, also providing a relatively level lateral spread and resisting longitudinal sag brought on by loads, all without necessitating the use of more than two rigid members each only as long as the structure is wide, and also without requiring that the shelter by any means attach to the ground for any reason.

11. An article of manufacture for a portable structure suspended above the ground as claimed in claim 10 wherein means for inserting said spreader bars comprises a sewn fold of the shortest edge of said floor, forming a cylindrical shape.

12. An article of manufacture for a portable structure suspended above the ground as claimed in claim 10 wherein said support means for suspending said structure from load bearing members comprises two lines for removable attachment to each of said load bearing members.

13. An article of manufacture for a portable structure suspended above the ground as claimed in claim 12 further comprising means for removably attaching said lines to said framework.

14. An article of manufacture for a portable structure suspended above the ground as claimed in claim 10 further comprising a length of material attached along edges of said floor and hanging therefrom as means for preventing the contact of rain water to said lines reinforcing said floor.

15. An article of manufacture for a portable structure suspended above the ground as claimed in claim 10 further comprising a length of material, approximately equivalent to the length and width of said floor material, attached along lines parallel to and in close proximity to at least one of said floor and along said lower load lines and completely covering the underside of said floor, preventing contact to an underside of said floor and all lines along the underside of said floor to the elements.

16. An article of manufacture for a portable structure suspended above the ground comprising a rigid or semi-rigid floor supported by a plurality of load lines, adding strength to the floor and also providing attachment means for attaching the lower portion of said shelter to two load bearing members separate from one another by at least the distance of said structure; a flexible framework including load lines running above, parallel and slightly inward of the longest edges of said floor, providing attachment means for attaching the upper portion of said shelter to an upper portion of said load bearing members or other appropriate members of equal or higher elevation than upper load lines; having vertical load lines interconnecting said upper load lines with said floor and support lines thereof; said framework providing a structure which distributes the weight of a load evenly or near-evenly among the upper load lines and lower load lines and eventually the attachment means to said load bearing members and to the members themselves, also maintaining itself in an upright position regardless of where a load may be placed on said floor and also regardless of moderate to heavy winds, also providing a relatively level lateral spread and resisting possible longitudinal sag brought on by loads, all without requiring that the structure by any means attach to the ground for any reason.

17. An article manufacture for a portable structure suspended above the ground as claimed in claim 16 further comprising means for laterally stressing said floor when said structure is suspended, the means consisting of two spreader bars along each of shortest edges of said floor.

18. An article of manufacture for a portable structure suspended above the ground as claimed in claim 16 further comprising a canopy suspended over said floor for enclosing a space, including means for passage through said canopy, the canopy itself suspended upward at least in part by means of said upper load lines.

19. An article of manufacture for a portable structure suspended above the ground as claimed in claim 18 further comprising material(s) attached to both shortest edges of said floor and to said canopy, thus covering space between said canopy and said floor at either end of said floor; said floor, said canopy, and said end covers define an enclosed shelter.

* * * * *